US006694526B1

(12) United States Patent
Tate

(10) Patent No.: US 6,694,526 B1
(45) Date of Patent: Feb. 24, 2004

(54) ROTATABLE CLIP

(76) Inventor: John R. Tate, 11621 Markon Dr., Garden Grove, CA (US) 92841-1810

( * ) Notice: Subject to any disclaimer, the term of this patent is extended or adjusted under 35 U.S.C. 154(b) by 0 days.

(21) Appl. No.: 10/414,377

(22) Filed: Apr. 15, 2003

(51) Int. Cl.[7] ..... A42B 1/00

(52) U.S. Cl. ..... 2/209.12; 24/3.12; 40/329; 40/666

(58) Field of Search ..... 2/69, 77, 171, 2/209.12; 24/3.1, 3.11, 3.12; 40/1.5, 329, 666, 492; 224/918

(56) References Cited

U.S. PATENT DOCUMENTS

| | | | | | |
|---|---|---|---|---|---|
| 3,139,690 | A | * | 7/1964 | Hait | 40/1.5 |
| 3,233,802 | A | | 2/1966 | Ludwick | |
| 3,298,579 | A | | 1/1967 | Smith | |
| D249,570 | S | | 9/1978 | Studt | |
| 4,406,040 | A | * | 9/1983 | Cannone | 24/3.12 |
| 4,475,676 | A | | 10/1984 | Smith | |
| 4,507,344 | A | * | 3/1985 | Baughman | 428/99 |
| 4,530,500 | A | * | 7/1985 | Kaymen | 473/406 |
| 4,736,877 | A | * | 4/1988 | Clark | 224/666 |
| D301,286 | S | | 5/1989 | Hird | |
| 5,067,265 | A | * | 11/1991 | Harms | 40/1.5 |
| 5,426,825 | A | * | 6/1995 | Soren et al. | 24/3.12 |
| 5,795,248 | A | * | 8/1998 | Giglio | 473/406 |
| 5,867,874 | A | * | 2/1999 | Simpson | 24/336 |
| 6,035,564 | A | * | 3/2000 | Cosmo et al. | 40/1.6 |
| 6,422,955 | B1 | * | 7/2002 | Lopez | 473/406 |

FOREIGN PATENT DOCUMENTS

| | | | | |
|---|---|---|---|---|
| GB | 2 266 744 | * | 11/1993 | A44C/3/00 |

* cited by examiner

*Primary Examiner*—Gary L. Welch
(74) *Attorney, Agent, or Firm*—Charles H. Thomas

(57) ABSTRACT

A golf accessory clip is provided with a garment fastener that clips onto a golf garment, such as the bill of a golf hat or the edge of a golf shirt. The golf accessory clip is provided with a shield portion that is rotatable relative to a mounting base. The shield portion bears a surface embellishment which may be considered to have a top and a bottom for purposes of viewing. By providing a rotatable connection between the shield and the mounting base, the golf accessory clip may be utilized in a wide variety of ways and clipped onto many different golf garments while still allowing the shield to be oriented and reoriented so that the surface embellishment thereon is always right side up. The coupling between the underside of the shield and the mounting structure on the garment fastener is preferably formed as a dovetail connection that permits rotation of the shield relative to the fastener, but which holds the shield and fastener coupled together.

14 Claims, 3 Drawing Sheets

ROTATABLE CLIP

BACKGROUND OF THE INVENTION

1. Field of the Invention

The present invention relates to a golf accessory clip for attachment to a golfing garment having a shield portion that is rotatable relative to an underlying base portion.

2. Description of the Prior Art

In golfing tournaments and other events in the field of golf participants and spectators often wear clips which bear surface embellishments, such as designs, logos, company names, participant names, and other words or designs intended to be read or observed by others. Clips of this type are often attached to a golf garment, such as an article of headwear, a shirt pocket, a trouser pocket, a belt, or other garment articles often worn by golfers and spectators at golfing events.

More often than not the surface embellishments that appear on clips of this type are intended to be read and observed from a particular orientation. That is, if the shield of the clip contains the name of a participant, the name or indicia of a tournament, a country club or corporate logo, or other indica logically having a top and a bottom, it is highly desirable for the shield to appear in an orientation in which it can easily be read when worn on golf garment. That is, it is quite desirable for the information or design to appear right side up when viewed by an observer.

Conventional golf accessory clips of this type are not adaptable for attachment to different articles of golf garments or in different ways to the same golf garment in a manner that allows the information on the shield to always appear right side up. For example, a conventional golf clip typically has a shield element or member from which a hooked return extends in one direction and then is looped back around beneath the shield. This looped return carries a clamping element that is designed to grip a fabric or plastic material of a golf garment that is inserted in between the underside of the shield and the clamping element. However, while the surface embellishment of the shield may be printed in a manner so that it appears right side up when the clip is worn on one golf garment, that same surface embellishment will be at a distinct angle, or even upside down, when the clip is attached to a different golf garment.

To illustrate, a clip of the type described may have the surface embellishment printed on its shield such that the top of the information displayed is located proximate the hooked return that attaches over the edge of a golf garment. When such a clip is worn clipped onto the upper edge of the patch of material on a golf shirt forming a chest pocket, the information displayed on the shield appears in a proper orientation, right side up. However, if the same clip is attached to the lower edge of the headband of a golf hat or sun visor, the information imprinted on the shield will appear upside down to an observer. Until the present invention, golf clips have not been adaptable for wear in different orientations without compromising the orientation of the surface embellishment displayed on the shield.

SUMMARY OF THE INVENTION

The present invention provides a display clip used as a golf accessory which has a versatility for displaying surface embellishments in different orientations relative to the functional attachment mechanism of the structure of the clip. That is, the golf clip of the present invention may be clipped onto golf garments with the garment attachment mechanism oriented in any direction while allowing the surface embellishment on the shield of the golf clip to be displayed in a proper, upright orientation.

One object of the present invention is to provide a golf clip bearing a surface embellishment which can be attached to a golf garment in a variety of ways while always maintaining the surface embellishment in an appropriate orientation for observation.

Another object of the invention is to provide a golf clip designed for attachment to a golf garment with a shield bearing a surface embellishment that may be rotated relative to the attachment or garment fastening mechanism of the clip quickly and easily by the user without disassembling any of the parts of the clip.

Another related object of the invention is to provide a golf clip that has the versatility of being attached to different golf garments while always maintaining a surface embellishment displayed on the shield of the clip in an appropriate orientation for observation, irrespective of the orientation of attachment of the fastening mechanism of the clip to a golf garment.

In one broad aspect the present invention may be considered to be a golf accessory clip comprising: a mounting button having a top and an opposing bottom end; an arcuately curved outer perimeter; a fastener connected to the mounting button for releaseable attachment to a golf garment; and a shield portion having an exposed surface bearing a surface embellishment thereon and having an opposing underside with a circular cavity defined therewithin. The circular cavity is configured to receive at least the top of the mounting button therewithin. The shield portion is thereby secured atop the mounting button and is also rotatable relative thereto.

In another broad aspect the present invention may be considered to be a golf accessory clip comprising: a mounting ring having a top and a bottom and formed with a central circularly curved opening therein; a fastener for releaseable attachment to a golf garment connected to the mounting ring; and a shield portion having an under surface with an annular cavity defined therein with a circular mounting button at its center and an opposing exposed side with a surface embellishment thereon. The shield portion is mounted atop the mounting ring with the mounting button depending into and captured by the central opening in the mounting ring. The shield is thereby secured to the mounting ring and is rotatable relative thereto.

In still another broad aspect the invention may be considered to be a combination of a garment of golf wearing apparel and a golf accessory clip having a unique construction. Specifically, the golf accessory clip has a mounting base with a garment fastener attached thereto and a shield portion having an exposed surface bearing a surface embellishment thereon. The shield portion also has an opposing under surface at which the shield portion is secured to and mounted for rotation relative to the mounting base. The golf accessory clip is removably secured to the garment by the garment fastener and the shield portion is rotatable relative to the garment to alter the orientation of the surface embellishment relative to the garment as desired.

The interconnection between the mounting base and the shield should be such that the shield is rotatable relative to the mounting base, but otherwise remains connected thereto. That is, the shield should be immobilized from separation from the mounting base along the axis of rotation.

The shield and mounting base may either be permanently coupled together, or they may be releaseably separable from each other. In one preferred embodiment of the invention the mounting base may be configured as a flat, general annular structure, but with a radial slot defined therein. The mounting base thereby has the shape of a slotted ring. Stated another way, the mounting base has a generally "C"-shaped configuration.

The outer peripheral edge of the mounting base and either the inwardly facing wall of the cavity in the under surface of the shield, or the radially outwardly facing surface of the mounting button at the center of the cavity of the shield preferably have a mating, dovetail cross section. The complementary peripheral edges of the shallow cavity in the underside of the shield and the mounting base thereby fit together in interlocking fashion. Together they have a dovetail cross section as viewed in a plane containing the axis or rotation of the shield relative to the mounting base.

The invention may be described with greater clarity and particularity with reference to the accompanying drawings.

DESCRIPTION OF THE EMBODIMENTS

Figure 1:
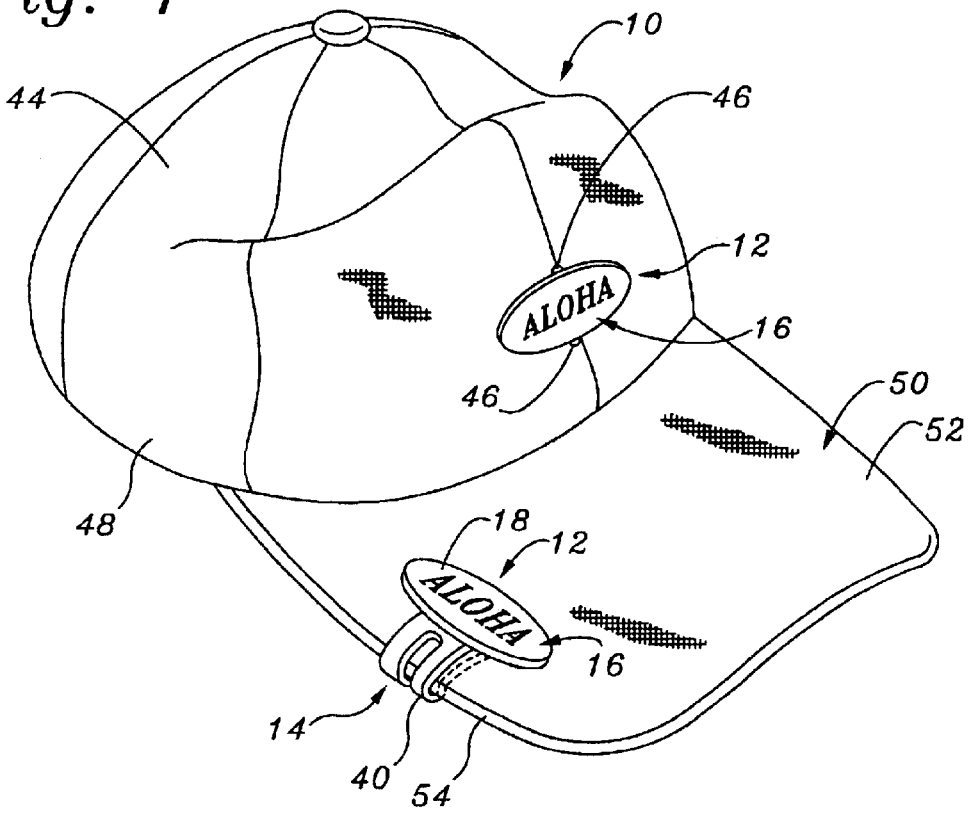
FIG. 1 is perspective view of an article of golf headwear bearing two identical golf accessory clips, the shields of which are oriented differently relative to their respective mounting structures.

FIG. 1 illustrates the combination of a garment of golf wearing apparel, which is a golf hat 10, and two identical golf accessory clips 12. The golf accessory clip 12 has a mounting base 13, visible in FIGS. 3–5, with a garment fastener 14 attached thereto and a shield portion 16 having an exposed surface 18 bearing a surface embellishment thereon. In this embodiment the shield portion 16 of the golf accessory clip 12 bears as a surface embellishment the word "ALOHA", although it could be any word, combination of words, design, logo, or combination thereof.

As will hereinafter be described, the shield portion 16 is mounted for rotation relative to the mounting base 13. The golf accessory clip 12 is removably secured to the golf hat 10 by the garment fastener 14 and the shield portion 16 is rotatable relative to the garment to alter the orientation of the surface embellishment, that is, the word "ALOHA", relative to the garment, as desired.

Figure 3:
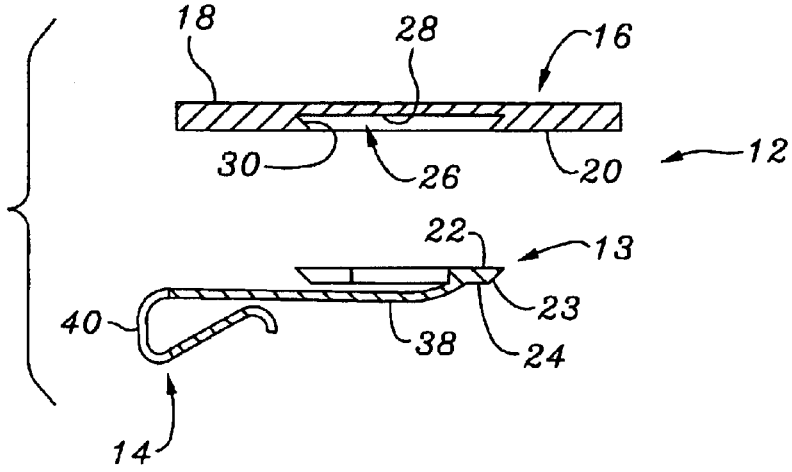
FIG. 3 is an exploded sectional elevational view illustrating the component parts of the embodiment of the golf clip shown in FIGS. 1 and 2.
Figure 4:
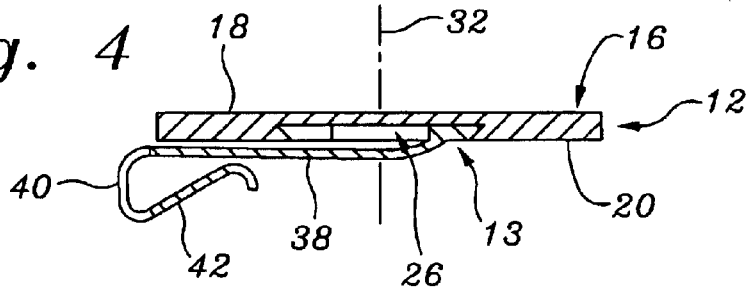
FIG. 4 is a sectional elevational view illustrating the component parts of the golf clip of FIG. 3 secured together.
Figure 5:
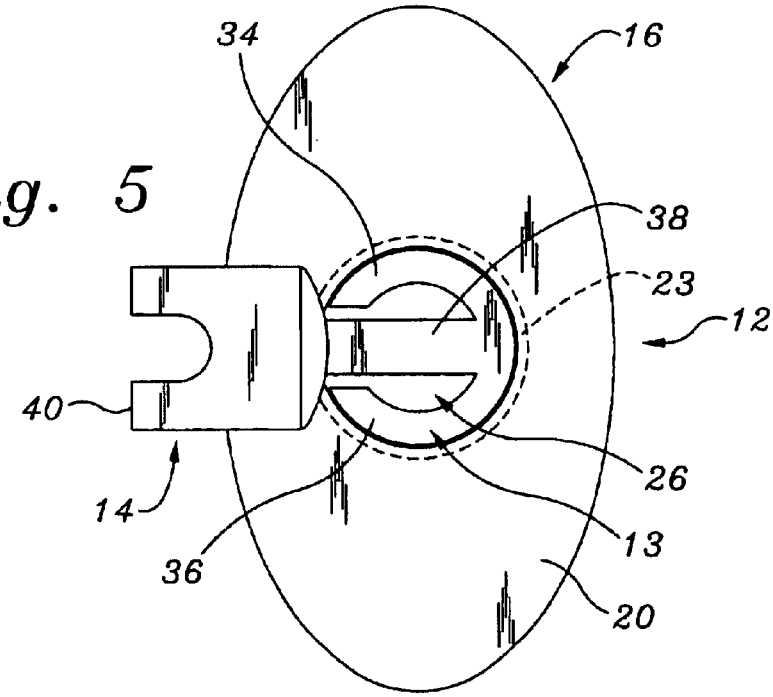
FIG. 5 is a bottom plan view of the golf clip illustrated in FIG. 4.

As illustrated in the FIGS. 3–5, the shield portion 16 is a flat, oval-shaped structure having an exposed surface 18 and an opposing under surface 20 at which the shield portion 16 is mounted for rotation relative to the mounting base 13. The mounting base 13 is configured as a flat, generally C-shaped mounting button having a flat top 22 and a flat bottom 24. The outer, peripheral edge 23 of the mounting button 13 has an outer perimeter that is arcuately curved about a mounting button axis 32 and which has a greater diameter of curvature at the top 22 than at the bottom 24.

The under surface 20 of the shield portion 16 has a shallow cavity 26 defined therein at its center. The shallow cavity 26 has a circular floor 28 and an outwardly tapered side wall 30 that also has a circular shape when viewed from the under surface 20, but which decreases in cross section with distance from the cavity floor 28. The cavity 26 thereby has a frustoconical shape.

The side wall 30 of the cavity 26 has a diameter and angle of taper that matches the diameter and angle of taper of the peripheral edge 23 of the mounting button 13. The cavity peripheral side wall 30 and the radially outer peripheral edge 23 of the mounting button are complementary in shape and have a dovetail cross section, as illustrated in FIGS. 3 and 4. The peripheral edge 23 of the mounting button 13 and the cavity side wall 30 of the shallow cavity 26 fit together in interlocking fashion, as illustrated in FIG. 4.

As is evident from FIGS. 4 and 5, the shield portion 16 of the golf clip 12 can be rotated relative to the remaining structure of the golf clip 12 about the central axis of rotation 32. The axis of rotation 32 is perpendicular to the shield portion 16 and passes through its center. It is also perpendicular to both the top 22 and bottom 24 of the mounting button 13 and likewise passes through the center of the mounting button 13. Thus, while the shield portion 16 is freely rotatable relative to both the garment fastener 14 and the mounting button 13, it is coupled to the mounting button 13 and longitudinally immobilized relative thereto.

The mounting button 13 is illustrated in plan view in FIG. 5. As shown in that drawing figure, the mounting button 13 has a C-shaped cross section with a pair of mutually opposing arcuate arms 34 and 36 that are coupled together on the side of the mounting button 13 at which a mounting base support arm 38 is attached. The opposite ends of the arcuate arms 34 and 36 are separated by a relatively narrow gap.

Due to their length, the arcuate arms 34 and 36 may be compressed slightly toward each other to temporarily reduce the outer diameter of the peripheral edge 23 of the mounting button 13. The arcuate arms 34 and 36 are elastically resilient enough to permit compression toward each other for releaseable engagement with the side wall 30 of the cavity 26. This enables the arcuate arms 34 and 36 to be pressed into and enter the cavity 26 in the shield portion 16. The structure of the mounting button 13 is resilient enough so that once the arcuate arms 34 and 36 have been pressed toward each other and the mounting button 13 has been pushed into the cavity 26, the arcuate arms 34 and 36 will return to their original configuration, when released. That is, and is evident in FIG. 5, once the arcuate mounting arms 34 and 36 are released within the cavity 26, they spring apart slightly so that there is an overhang created by the structure of the shield portion 16 at the under surface 20 that entraps at least the top of the mounting button 13 within the cavity 26. In the embodiment of the invention illustrated in FIGS. 3–5, the entire mounting button 13 is entrapped within the cavity 26.

The mounting button support arm 38 of the golf accessory 12 extends from its connection to the mounting button 13 at the junction of the arcuate arms 34 and 36 and passes diametrically across and beneath the bottom 24 of the mounting button 13 and radially outwardly relative to the axis of rotation 32 toward the peripheral outer edge of the shield portion 16. The mounting button support arm 38 is then bent to from a hook-shaped return 40. The hooked return 40 is displaced laterally from the mounting button 13 and passes over the exposed edge of the garment structure. The hooked return 40 is then bent back around to form a clamping member or arm 42 that resides beneath the mounting button support arm 38, which in turn passes beneath the mounting button 13. The clamping arm 42 is located below the mounting button 13. The return portion 40 of the golf accessory clip 12 thereby joins the clamping member 42 to the mounting base support arm 38. Together the mounting button support arm 38, the return portion 40, and the clamping member 42 form a fastener system for attaching the shield portion 16 to a golf garment.

Figure 2:
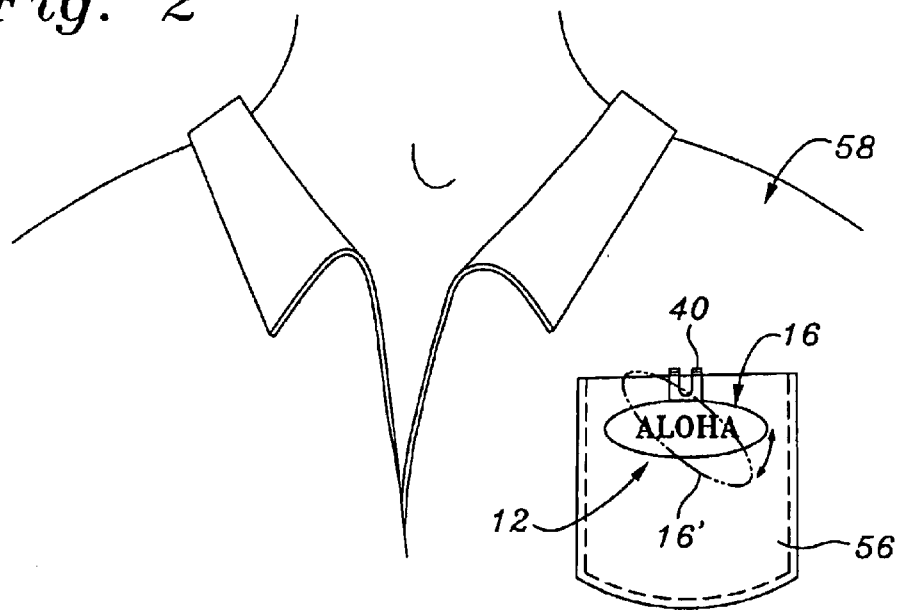
FIG. 2 illustrates one of the clips of FIG. 1 attached to the pocket of a golf shirt.

As illustrated in FIGS. 1 and 2, each of the garments depicted includes a thin structure having an exposed side and a concealed side delineated by a garment edge. More specifically, the golf hat 10 is a conventional golf hat formed with a crown 44 located atop an encircling headband portion 48. From the front of the headband portion 48 the golf hat 10 has stiff bill 50 that projects forwardly. The bill 50 has a top surface 52 and an opposing under surface (not visible). The edge 54 of the hat bill 50 is a curved, peripheral edge. The peripheral edge 54 of the hat bill 50 serves as the demarcation between the exposed, upper top surface 52 and the underside of the hat bill 50.

Similarly, the outer surface of the crown 44 is exposed, while the under surface of the crown facing the wearer'head is concealed. In the golf hat 10 depicted in FIG. 1, a vertically oriented button hole or slit is formed at the front of the crown 44. The longitudinal extremities 46 of the button hole slit are barely visible above and below the shield portion 16 of the golf accessory clip 12.

As illustrated in FIG. 1, the return 40 of one of the golf accessory clips 12 may be placed onto the edge 54 of the hat bill 50. The golf accessory clip 12 is removable secured to the bill 50 by the fastener 14 at the peripheral edge 54 of the bill 50. The structure of the golf accessory clip 12 is formed of a resilient metal, such as heat treated steel, so that there is a certain springiness to the clamping arm 42. The return 40 of the golf clip 12 may be pressed laterally onto the edge 54 of the golf hat bill 50 so that the clamping arm 42 is spread slightly from the support arm 38. The hat bill 50 is thereby gripped by the pinching action of the clamping arm 42 toward the support arm 38.

As is evident from FIGS. 4 and 5, the shield portion 16 of the golf accessory clip 12 may be rotated relative to the mounting button 13 to orient the surface embellishment of the shield portion 16 as desired by the wearer. To illustrate, the shield portion 16 of the golf accessory clip 12 that is placed on the edge 54 of the hat bill 50 is oriented so that the alignment of the shield portion 16 is generally parallel to the hat bill edge 54. The shield portion 16 is thereby aligned substantially perpendicular to the alignment of the mounting support arm 38. The surface embellishment "ALOHA" is thereby oriented in an upright disposition to an observer looking at the golf hat 10 from the side of the bill 50 to which the golf accessory 12 is attached.

However, since the shield portion 16 of the golf accessory clip 12 is rotatable relative to the mounting button 13, the orientation of the shield portion 16 may be changed at will. For example, the golf accessory clip 12 may be attached to the front of the crown 44 of the golf hat 10 through the button hole slit 46. The clamping arm 42, the return 40, and the support arm 38 of the golf accessory clip 12 will then be in a substantially horizontal orientation when the golf hat 10 is worn by a golfer. The shield portion 16 of the other golf accessory clip 12 that is attached to the crown 44 of the hat 10 is therefore rotated ninety degrees from the orientation of the shield 16 of the golf accessory clip 12 that is attached to the hat bill 50. That is, the alignment of the shield 16 of the other golf accessory clip 12 is essentially parallel to the alignment of the mounting support arm 38 and clamping member 42.

Due to its versatility, the golf accessory clip 12 may be worn on virtually any golf garment having an edge at which the return 40 can be attached. Also it can be worn so that the shield portion 16 is in any orientation. For example, the golf accessory clip 12 attached to the edge 54 of the hat bill 50 can be easily detached therefrom merely by sliding the return 40 away from the hat bill 50 and reattached to the lower edge of the hat band portion 48 of the golf hat 10. The surface embellishment "ALOHA" will still be in an upright orientation for observation by an observer.

That same golf accessory clip 12 can the be removed from the hat 10 entirely and the shield portion 16 rotated one hundred eighty degrees relative to the mounting button 38. The return 40 can then be hooked over the upwardly facing fabric edge of the shirt pocket 56 of a golf shirt 58, as illustrated in FIG. 2. Also as indicated in that drawing figure, the shield portion 16 may be rotated to any orientation relative to the structure of the golf accessory clip 12, as indicated in phantom at 16'. The orientation of the shield 16 is entirely adjustable as desired by the wearer of the golf garment.

Figure 6:
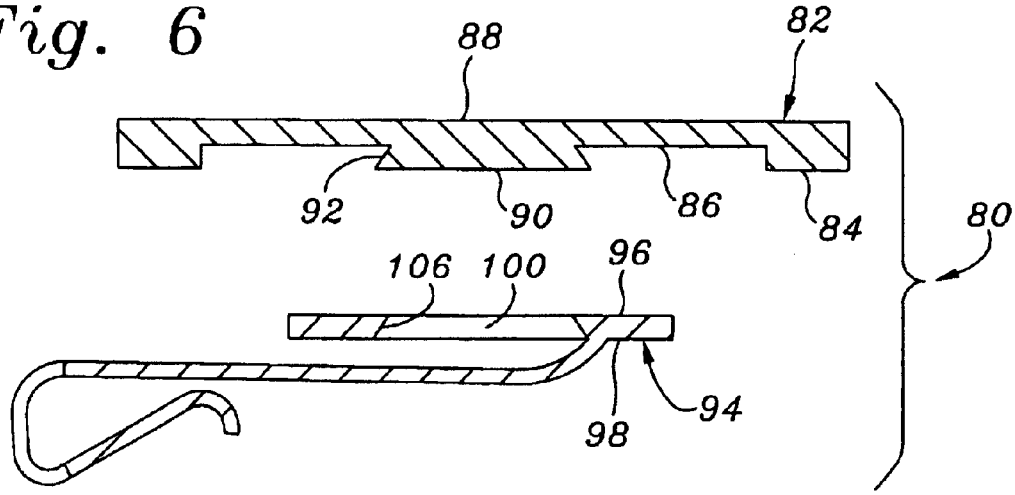
FIG. 6 is an exploded sectional elevational view of the component parts of an alternative embodiment of a golf clip according to the invention.
Figure 7:
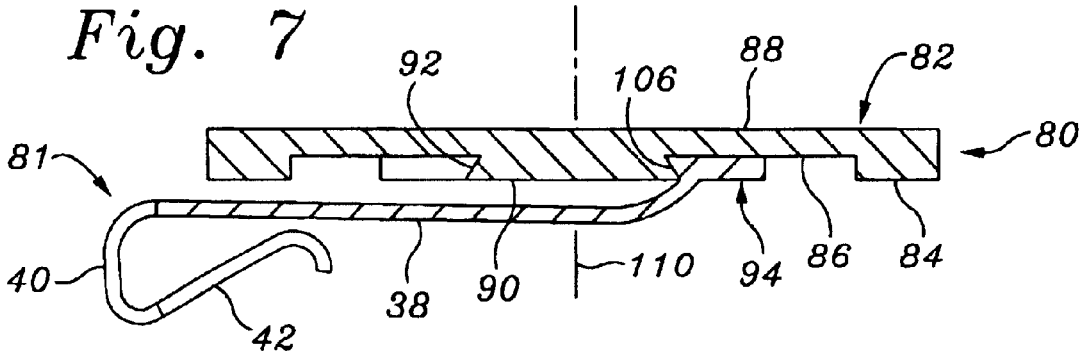
FIG. 7 is a sectional elevational view illustrating the component parts of the golf clip of FIG. 6 assembled together.
Figure 8:
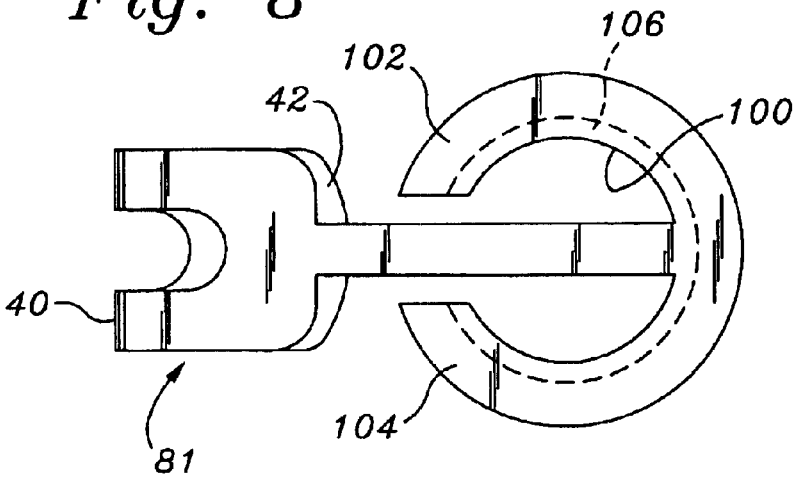
FIG. 8 is a bottom plan view illustrating the component element that forms the mounting ring and garment fastener of the golf clip of FIG. 7, shown in isolation.

FIGS. 6–8 illustrate an alternative embodiment of a golf accessory clip 80. The golf accessory clip 80 has a shield portion 82 having an under surface 84 in which a shallow, circular, annular cavity 86 is defined, and an opposing exposed side 88 with a surface embellishment thereon. A circular mounting button 90 is formed at the underside 84 of the shield portion 82 at the center of the annular cavity 86. The mounting button 90 has a tapered outer periphery that creates a dovetail peripheral wall 92.

The golf accessory clip 80 is further comprised of a mounting base which is a thin structure formed as a flat mounting ring 94 having a top 96 and a bottom 98. The mounting ring 94 is formed with a central, circularly curved opening 100 therein formed about a central axis 110. As illustrated in FIG. 8, the mounting ring 94 is actually a slotted ring that is a generally C-shaped structure, much like the mounting button 13. That is, the mounting ring 94 has opposing, arcuately curved arms 102 and 104.

In the embodiment of FIGS. 6–8, the dovetail connection between the slotted mounting ring 94 and the mounting button 90 is created by a tapered interior peripheral. edge 106 delineating the central opening 100 around the inner circumference thereof formed by the arcuately curved arms 102 and 104. That is, the inner peripheral edge 106 of the slotted mounting ring 94 tapers so that the central opening 100 in the slotted mounting ring 94 is smallest in diameter at the upper surface 96 of the slotted mounting ring 94, and greatest in diameter at the lower surface 98 of the slotted mounting ring 94.

To attach the slotted mounting ring 94 to the mounting button 90 at the underside of the shield portion 82, the arcuately curved arms 102 and 104 of the mounting ring 104 are spread slightly apart from each other to permit passage of the mounting button 90 through the central opening 100 in the slotted mounting ring 94. The arcuately curved arms 102 and 104 of the slotted mounting ring 94 are elastically resilient enough to permit passage of the mounting button 90 therebetween for releaseable engagement with the outer peripheral edge 92 of the mounting button 90. The slotted mounting ring 94 of the mounting base of the fastener 81 fits into the annular cavity 86. The mounting button 90 at the underside of the shield portion 82 fits into the central opening 100 of the slotted mounting ring 94.

When the arcuately curved arms 102 and 104 are released, the resiliency of the slotted mounting ring 94 is such that they return to their original position and entrap the mounting button 90 within their lateral embrace. However, because the opening 100 and the mounting button 90 are both formed with a mating, circular curvature, the shield 82 may be easily rotated about the axis 110 which passes through the center of the mounting button 90 and the center of the opening 100. Since the slotted mounting ring 94 has an inner dovetail edge 106, and the mounting button 90 has an outer peripheral dovetail edge 92, the slotted mounting ring 94 and the mounting button 90 fit together in interlocking fashion. The dovetail coupling formed between the inner wall surface 106 of the slotted mounting ring 94 and the outer wall surface 92 of the mounting button 90 permit rotation of the shield portion 82 relative to the slotted mounting ring 94, but longitudinally immobilize these structures relative to each other.

The golf accessory clip 80 is provided with a fastener portion 81. The fastener portion 81 of the golf accessory clip 80 is utilized to removably secure the golf accessory clip 80 to a garment, such as the hat 10 illustrated in FIG. 1, or the golf shirt 58, illustrated in FIG. 2. The clamping arm 42 resides in contact with the concealed side of the garment structure. The return 40 joins the clamping member 42 to the slotted mounting ring 94 by its connection thereto through the mounting support arm 38. As in the golf accessory clip 12, the fastener portion 81 has a mounting support arm 38, a return 40, and a clamping arm 42 that perform an identical function as described in connection with the embodiment of the invention illustrated in FIGS. 3–5.

Together the mounting support arm 30, the return 40, and the clamping arm 42 form a fastener for releaseable attachment to a golf garment, such as the golf hat 10 or the golf shirt 58. The mounting arm 38 is joined to the slotted mounting ring 94 at a location diametrically opposite the gap between the arcuately curved arms 102 and 104 of the slotted mounting ring 94. The shield portion 82 is mounted atop the slotted mounting ring 94 with the mounting button 90 depending into and captured by the interior wall 106 of the central opening 100 in the slotted mounting ring 94. In this manner the shield portion 82 is secured to the slotted mounting ring 94 and is rotatable relative thereto.

The golf accessory clip 80 may be attached to a garment in the same manner as the golf accessory clip 12 illustrated in FIGS. 1 and 2. The mounting base, which in the embodiment of FIGS. 6–8 is the slotted mounting ring 94, is located on the exposed side of the garment structure when the golf accessory clip 80 is attached to the garment. When the golf accessory clip is utilized in combination with a garment, the return portion 40 passes over the exposed edge of the golf garment structure, such as the edge 54 of the golf hat bill 50 or the top edge of the shirt pocket 56 as shown in FIG. 2.

Undoubtedly, numerous variations and modifications of the invention will become readily apparent to those familiar with the game of golf and golf accessories. Accordingly, the scope of the invention should not be construed as limited to the specific embodiment depicted and described, but rather is defined in the claims appended hereto.

I claim:

1. In combination:

a garment of golf wearing apparel, a golf accessory clip having a mounting base with a garment fastener attached thereto and a shield portion having an exposed surface bearing a surface embellishment thereon and an opposing under surface at which said shield portion is secured to and mounted for rotation relative to said mounting base, and said golf accessory clip is removably secured to said garment by said garment fastener, and that said shield portion is rotatable relative to said garment to alter the orientation of said surface embellishment relative to said garment as desired, wherein said mounting base is a thin structure having a flat, circularly curved mounting button with a central button axis and a shallow cavity having a circular curvature is defined in said under surface of said shield, and said mounting button is secured in said cavity of said under surface of said shield, whereby said shield is rotatable relative to said mounting button about said button axis.

2. A combination according to claim 1 wherein said garment includes a thin structure having an exposed side and a concealed side delineated by a garments edge and said faster is comprised of a clamping member that resides in contact with said concealed side of said garment structure and said mounting base is located on said exposed side of said garment structure, and said golf clip includes a return portion that passes over said exposed edge of said garment structure to join said clamping member to said mounting base.

3. A combination according to claim 1 wherein said mounting button and said shallow cavity have complementary peripheral edges of dovetail cross section that fit together in interlocking fashion.

4. A combination according to claim 3 wherein said mounting button has a C-shaped configuration with a pair of mutually opposing arms that are elastically resilient enough to permit compression toward each other for releaseable engagement with said peripheral edge of said cavity.

5. A combination according to claim 1 wherein said garment of golf wearing apparel is an article of golf headgear having an encircling headband with a stiff bill projecting therefrom terminating in a curved, peripheral edge, and said golf accessory clip is removably secured to said bill by said fastener at said peripheral edge of said bill.

6. A combination according to claim 1 wherein said garment of golf apparel has a pocket with a free edge, and said golf accessory clip is secured to said pocket by said fastener at said free edge of said pocket.

7. In combination:

a garment of golf wearing apparel, a golf accessory clip having a mounting base with a garment fastener attached thereto and a shield portion having an exposed surface bearing a surface embellishment thereon and an opposing under surface at which said shield portion is secured to and mounted for rotation relative to said mounting base, and said golf accessory clip is removably secured to said garment by said garment fastener, and that said shield portion is rotatable relative to said garment to alter the orientation of said surface embellishment relative to said garment as desired, wherein said mounting base is a thin structure having a flat, circularly curved mounting ring with a central mounting ring axis, and a shallow circular, annular cavity is defined in said under surface of said shield with a circular button at its center, and said mounting ring of said mounting base fits into said annular cavity and said mounting button at said underside of said shield fits into and is engaged with said mounting ring.

8. A combination according to claim 7 wherein said mounting ring has an inner dovetail edge and said mounting button has an outer peripheral dovetail edge, whereby said mounting ring and said mounting button fit together in interlocking fashion.

9. A combination according to claim 8 wherein said mounting ring is a slotted ring delineating a pair of mutually opposing, arcuate arms that are elastically resilient enough to spread to permit passage of said mounting button therebetween for releaseable engagement with said outer periphery of said mounting button.

10. A combination according to claim 7 wherein said garment of golf wearing apparel is an article of golf headgear having an encircling headband with a stiff bill projecting therefrom terminating in a curved, peripheral edge, and said golf accessory clip is removably secured to said bill by said fastener at said peripheral edge of said bill.

11. A combination according to claim 7 wherein said garment of golf apparel has a pocket with a free edge, and said golf accessory clip is secured to said pocket by said fastener at said free edge of said pocket.

12. A golf accessory clip comprising: a mounting ring having a top and a bottom and formed with a central circularly curved opening therein, a fastener for attachment to a golf garment connecting to said mounting ring, and a shield portion having an under surface with an annular cavity defined therein with a circular mounting button at its center and an opposing exposed side with a surface embellishment thereon, and said shield portion is mounted atop said mounting ring with said mounting button depending into and captured by said central opening in said mounting ring, whereby said shield is secured to said mounting ring and is rotatable relative thereto, wherein said fastener is formed with a return including a hooked portion extending laterally from said mounting ring and including a clamping element located below said mounting ring.

13. A golf accessory clip comprising: a mounting ring having a top and a bottom and formed with a central circularly curved opening therein, a fastener for attachment to a golf garment connecting to said mounting ring, and a shield portion having an under surface with an annular cavity defined therein with a circular mounting button at its center and an opposing exposed side with a surface embellishment thereon, and said shield portion is mounted atop said mounting ring with said mounting button depending into and captured by said central opening in said mounting ring, whereby said shield is secured to said mounting ring and is rotatable relative thereto, wherein said mounting ring has an inner dovetail edge and said mounting button has an outer peripheral dovetail edge, whereby said mounting ring and said mounting button fit together in interlocking fashion.

14. A combination according to claim 13 wherein said mounting ring is a slotted ring delineating a pair of mutually opposing, arcuate arms that are elastically resilient enough to spread apart to permit passage of said mounting button therebetween for releaseable engagement with said outer periphery of said mounting button.

* * * * *